US009175515B2

(12) United States Patent
Sihler

(10) Patent No.: US 9,175,515 B2
(45) Date of Patent: Nov. 3, 2015

(54) WIRED MUD MOTOR COMPONENTS, METHODS OF FABRICATING THE SAME, AND DOWNHOLE MOTORS INCORPORATING THE SAME

(75) Inventor: Joachim Sihler, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 764 days.

(21) Appl. No.: 12/977,278

(22) Filed: Dec. 23, 2010

(65) Prior Publication Data

US 2012/0160473 A1 Jun. 28, 2012

(51) Int. Cl.

| | |
|---|---|
| ***E21B 17/18*** | (2006.01) |
| ***E21B 4/02*** | (2006.01) |
| ***E21B 4/00*** | (2006.01) |
| ***E21B 17/00*** | (2006.01) |
| ***E21B 17/10*** | (2006.01) |
| ***E21B 21/10*** | (2006.01) |

(52) U.S. Cl.

CPC . *E21B 4/02* (2013.01); *E21B 4/003* (2013.01); *E21B 17/003* (2013.01); *E21B 17/1035* (2013.01); *E21B 21/103* (2013.01); *Y10T 29/49826* (2015.01)

(58) Field of Classification Search

USPC ..... 166/65.1, 104, 113, 243; 175/92–107, 175/320–326, 424; 340/354.9, 855.2

See application file for complete search history.

(56) References Cited

U.S. PATENT DOCUMENTS

| | | | | |
|---|---|---|---|---|
| 3,866,678 | A * | 2/1975 | Jeter | 340/854.3 |
| 3,894,818 | A * | 7/1975 | Tschirky | 418/48 |
| 4,788,544 | A * | 11/1988 | Howard | 340/853.7 |
| 5,113,953 | A * | 5/1992 | Noble | 175/61 |
| 5,265,682 | A | 11/1993 | Russell et al. | |
| 5,520,255 | A | 5/1996 | Barr et al. | |
| 5,553,678 | A | 9/1996 | Barr et al. | |
| 5,553,679 | A | 9/1996 | Thorp | |
| 5,577,564 | A * | 11/1996 | Le | 175/93 |
| 5,582,259 | A | 12/1996 | Barr | |
| 5,603,385 | A | 2/1997 | Colebrook | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |

(Continued)

FOREIGN PATENT DOCUMENTS

| | | |
|---|---|---|
| CN | 2413011 Y | 1/2001 |
| EP | 1780372 A1 | 5/2007 |
| WO | 9909290 A1 | 2/1999 |

OTHER PUBLICATIONS

Dictionary definition of "radial", accessed via www.thefreedictionary.com on Sep. 8, 2013.*

(Continued)

*Primary Examiner* — Blake Michener

(74) *Attorney, Agent, or Firm* — Kimberly Ballew; Mark D. Shelley, II

(57) ABSTRACT

Exemplary embodiments provide systems and methods for minimizing erosion of a transmission cable extending through a downhole drilling assembly. The drilling assembly includes an elongated flow diverter having a plurality of apertures for diverting the drilling fluid from an axial flow through a transmission shaft to a radial flow through a drive shaft. Exemplary flow diverters are configured to minimize erosion of transmission cables that may be present adjacent to the flow diverters.

24 Claims, 10 Drawing Sheets

(56) References Cited

U.S. PATENT DOCUMENTS

| | | | | |
|---|---|---|---|---|
| 5,725,061 | A * | 3/1998 | Van Steenwyk et al. | 175/104 |
| 5,778,992 | A | 7/1998 | Fuller | |
| 5,803,185 | A | 9/1998 | Barr et al. | |
| 5,971,085 | A | 10/1999 | Colebrook | |
| 6,089,332 | A | 7/2000 | Barr et al. | |
| 6,092,610 | A | 7/2000 | Kosmala et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 6,427,783 | B2 * | 8/2002 | Krueger et al. | 175/40 |
| 2001/0052428 | A1 | 12/2001 | Larronde et al. | |
| 2002/0011359 | A1 | 1/2002 | Webb et al. | |
| 2003/0056990 | A1 * | 3/2003 | Oglesby | 175/57 |
| 2007/0251729 | A1 * | 11/2007 | Sand et al. | 175/107 |
| 2007/0257812 | A1 * | 11/2007 | Lasater et al. | 340/854.8 |
| 2009/0321141 | A1 | 12/2009 | Kotsonis et al. | |
| 2010/0052941 | A1 * | 3/2010 | Madhavan et al. | 340/854.8 |
| 2010/0130027 | A1 * | 5/2010 | Sihler et al. | 439/26 |
| 2010/0187009 | A1 * | 7/2010 | Siher et al. | 175/57 |

OTHER PUBLICATIONS

GB Search Report from the equivalent GB patent application No. 1121470.7 issued on Feb. 14, 2012.

Office Action issued in CN201110459168.5 on Jan. 16, 2015, 12 pages.

* cited by examiner

WIRED MUD MOTOR COMPONENTS, METHODS OF FABRICATING THE SAME, AND DOWNHOLE MOTORS INCORPORATING THE SAME

BACKGROUND

Downhole motors (colloquially known as "mud motors") are powerful generators used in drilling operations to turn a drill bit. Downhole motors are often powered by a drilling fluid, such as mud, which is also used to lubricate the drill string and to transport cuttings and particulate matter away from the borehole. A downhole motor may act as a positive displacement motor in which a drilling fluid pumped through the interior converts hydraulic energy into mechanical energy to turn a drilling bit, which has applications in well drilling.

SUMMARY

In accordance with an exemplary embodiment, a system for drilling is provided. The system includes a drive shaft for transmitting a torque to a downhole tool, the drive shaft having a hollow central passage formed by a tubular wall extending along a longitudinal axis thereof. The hollow central passage allows a flow of a drilling fluid to a mud motor. The system also includes an elongated flow diverter disposed in the tubular wall of the drive shaft, the elongated flow diverter comprising a plurality of apertures for diverting the flow of the drilling fluid from an upstream section of the system to a bearing section of the system.

In accordance with another exemplary embodiment, a system for drilling is provided. The system includes a drive shaft for transmitting a torque to a downhole tool. The drive shaft has a tubular wall and a bore extending from a first end to a second end through the tubular wall along a longitudinal axis thereof. The system also includes a transmission cable extending through the bore in the tubular wall of the drive shaft for transmission of power, data and/or instructions to or from the downhole tool.

In accordance with another exemplary embodiment, a method for manufacturing a system for drilling is provided. The method includes receiving a drive shaft for transmitting a torque to a downhole tool, and forming a hollow central passage in an end wall of the drive shaft. The hollow central passage extends through the end wall along a longitudinal axis of the drive shaft. The method also includes disposing an elongated flow diverter in the tubular wall of the drive shaft, the elongated flow diverter comprising a plurality of apertures for diverting the flow of the drilling fluid from an upstream section of the system to a bearing section of the system.

In accordance with another exemplary embodiment, a method for manufacturing a system for drilling is provided. The method includes receiving a drive shaft for transmitting a torque to a downhole tool, and forming a bore extending from a first end to a second end through a tubular wall of the drive shaft along a longitudinal axis thereof. The method also includes providing a transmission cable that extends through the bore in the tubular wall of the drive shaft for transmission of power, data and/or instructions to or from the downhole tool.

One of ordinary skill in the art will appreciate that the present invention is not limited to the specific exemplary embodiments described above. Many alterations and modifications may be made by those having ordinary skill in the art without departing from the spirit and scope of the invention.

BRIEF DESCRIPTION OF THE DRAWINGS

The foregoing and other objects, aspects, features and advantages of exemplary embodiments will become more apparent and may be better understood by referring to the following description taken in conjunction with the accompanying drawings, in which.

DETAILED DESCRIPTION

Figure 1:
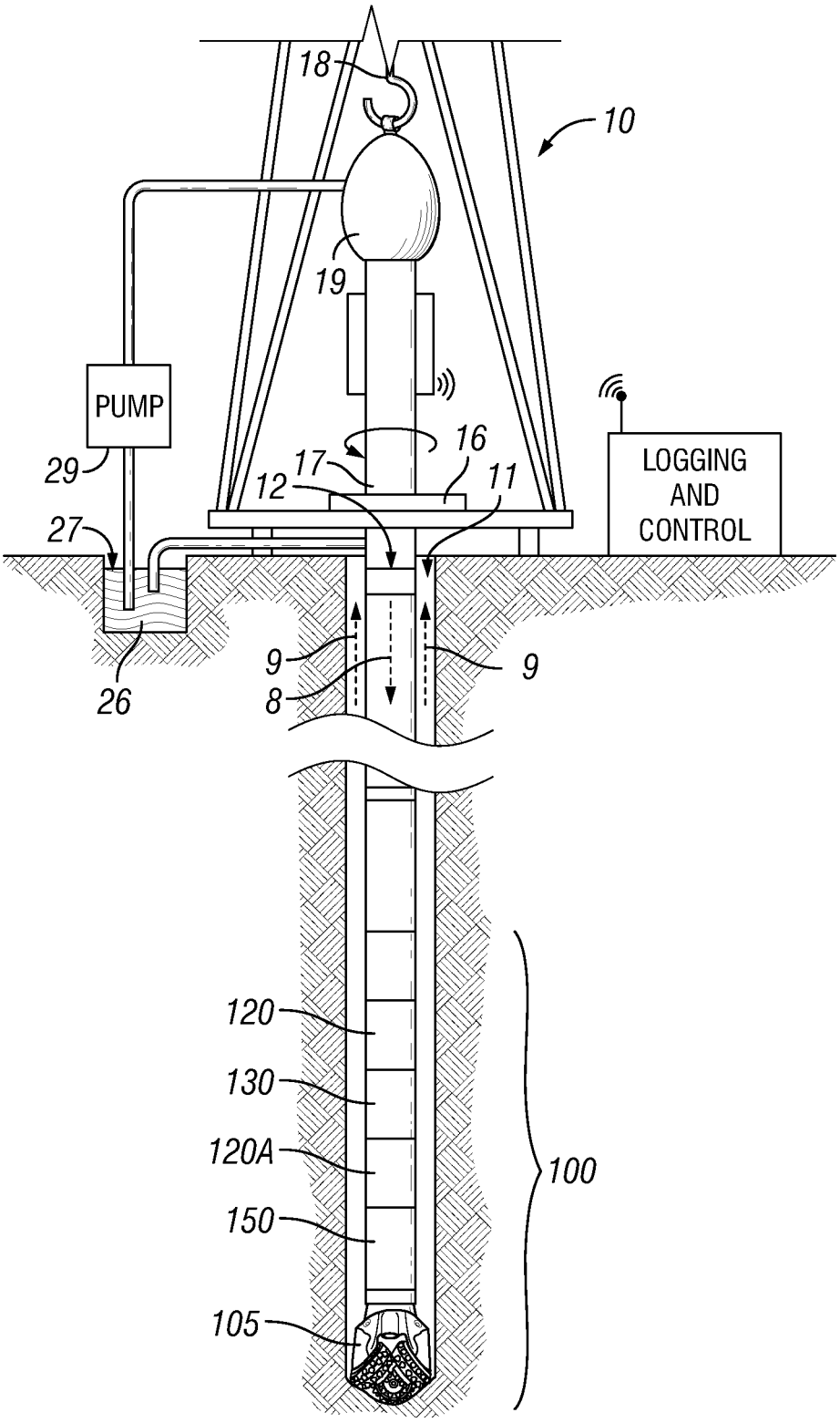
FIG. 1 illustrates an exemplary wellsite system in which exemplary embodiments may be employed.

Exemplary embodiments provide systems and methods for minimizing erosion of a transmission wire or cable that extends through a downhole drilling assembly. In an exemplary embodiment, a drilling system includes a mud motor having a drive shaft in its bearing section for transmitting torque to a downhole tool, e.g., a drill bit. The drive shaft includes a hollow central passage provided within and enclosed by a tubular wall extending along a longitudinal axis thereof. The hollow central passage allows a flow of a drilling fluid. The drilling system also includes a flow diverter disposed or formed in the tubular wall of the drive shaft for diverting the flow of the drilling fluid from an axial flow through a transmission passage to a radial flow through a central bore extending along a longitudinal axis of the drive shaft. The flow diverter is elongated and includes a plurality of apertures through which the drilling fluid flows. The elongated configuration of the flow diverter and the plurality of apertures minimize erosion of a transmission cable from a jetting effect created by the flow of the drilling fluid through the flow diverter. In some embodiments, a through hole is centrally located in an end wall of the drive shaft through which a transmission cable may extend.

In another exemplary embodiment, a drilling system includes a mud motor having a drive shaft in its bearing section for transmitting torque to a downhole tool, e.g., a drill bit. The drive shaft includes a hollow central passage provided within and enclosed by a tubular wall extending along a longitudinal axis thereof. The drive shaft includes a bore extending from a first end to a second end through the tubular wall along the longitudinal axis thereof. The bore may be gun-drilled in an exemplary embodiment. The drilling system includes a transmission cable extending through the bore in the tubular wall of the drive shaft. Because the transmission cable is provided in the bore extending through the tubular wall, the transmission cable is not in direct contact with the flow of the drilling fluid through a flow diverter. Thus, an exemplary configuration of the drive shaft that allows the transmission cable to extend through the bore of the tubular wall minimizes erosion of the transmission cable that would otherwise result from a jetting effect created by the flow of the drilling fluid through a conventional flow diverter.

As used herein, a transmission cable is a transmission medium or element for transmitting power, data and/or instructions encoded as electrical signals, optical signals and/or other suitable signals, and/or a combination of different signals and power. The power, data and/or instructions may be transmitted to or from one or more downhole tools, or between one or more uphole tools and one or more downhole tools. The transmission element may be any physical medium suitable for the transmission of the desired data and/or instructions including, but not limited to, co-axial cable, tri-axial cable, wire, wires, optical fiber(s), or fluid hydraulic control lines etc. In an exemplary embodiment, a flexible transmission cable includes an electrical wire or cable that runs in a longitudinal direction from a power section of a mud motor through the transmission section and the bearing section of the mud motor to a downhole tool to convey electrical power, electrical signals or both to or from the downhole tool. In another exemplary embodiment, a flexible transmission cable includes a fiber optic cable that transmits optical signals to or from the downhole tool.

FIG. 1 illustrates an exemplary wellsite system in which exemplary embodiments may be employed. The wellsite may be onshore or offshore. In an exemplary wellsite system, a borehole 11 is formed in subsurface formations by drilling. The method of drilling to form the borehole 11 may include, but is not limited to, rotary and directional drilling. A drill string 12 is suspended within the borehole 11 and has a bottom hole assembly (BHA) 100 that includes a drill bit 105 at its lower end.

An exemplary surface system includes a platform and derrick assembly 10 positioned over the borehole 11. An exemplary platform and derrick assembly 10 includes a rotary table 16, a kelly 17, a hook 18 and a rotary swivel 19. The drill string 12 is rotated by the rotary table 16, energized by means (not shown) which engages the kelly 17 at the upper end of the drill string 12. The drill string 12 is suspended from the hook 18, attached to a traveling block (not shown) through the kelly 17 and the rotary swivel 19 which permits rotation of the drill string 12 relative to the hook 18. A top drive system could alternatively be used in other exemplary embodiments.

An exemplary surface system also includes a drilling fluid 26, e.g., mud, stored in a pit 27 formed at the wellsite. In one exemplary embodiment, a pump 29 delivers the drilling fluid 26 to the interior of the drill string 12 via one or more ports in the swivel 19, causing the drilling fluid to flow downwardly through the drill string 12 as indicated by directional arrow 8. The drilling fluid exits the drill string 12 via one or more ports in the drill bit 105, and then circulates upwardly through the annular region between the outside of the drill string 12 and the wall of the borehole, as indicated by directional arrows 9. In this manner, the drilling fluid lubricates the drill bit 105 and carries formation cuttings and particulate matter up to the surface as it is returned to the pit 27 for recirculation.

In another exemplary embodiment, the wellsite system may be used in a reverse circulation application in which the pump 29 delivers the drilling fluid 26 to the annular region formed between the outside of the drill string 12 and drill bit 105 and the wall of the borehole, causing the drilling fluid to flow downwardly through the annular region. The drilling fluid is returned to the surface by being pumped upwardly through the interior of the drill string 12.

The exemplary bottom hole assembly 100 includes one or more logging-while-drilling (LWD) modules 120/120A, one or more measuring-while-drilling (MWD) modules 130, one or more roto-steerable systems and motors (not shown), and the drill bit 105. It will also be understood that more than one LWD module and/or more than one MWD module may be employed in exemplary embodiments, e.g. as represented at 120 and 120A.

The LWD module 120/120A is housed in a special type of drill collar, and includes capabilities for measuring, processing, and storing information, as well as for communicating with the surface equipment. The LWD module 120/120A may also include a pressure measuring device and one or more logging tools.

The MWD module 130 is also housed in a special type of drill collar, and includes one or more devices for measuring characteristics of the drill string 12 and drill bit 105. The MWD module 130 also includes one or more devices for generating electrical power for the downhole system. In an exemplary embodiment, the power generating devices include a mud turbine generator (also known as a "mud motor") powered by the flow of the drilling fluid. In other exemplary embodiments, other power and/or battery systems may be employed to generate power.

The MWD module 130 also includes one or more of the following types of measuring devices: a weight-on-bit measuring device, a torque measuring device, a vibration measuring device, a shock measuring device, a stick slip measuring device, a direction measuring device, and an inclination measuring device.

An exemplary wellsite system includes a conventional flow diverter adjustable to control the path along which the drilling fluid flows through the drill string 12. The flow diverter may be configured to divert the drilling fluid from an axial flow through a transmission passage to a radial flow through a drive shaft passage. The conventional flow diverter may be disposed in the mud motor of the BHA 100, e.g., in the transmission section and/or the bearing section.

The wellsite system may include a second flow diverter positioned just above the BHA 100 such that, in use, it is placed in an uncased section of the well. The second flow diverter may be a diverter configured to alter the pathway of the drilling fluid, as for the main flow diverter described above. Alternatively, the second flow diverter may be a simple non-configurable diverter, for example as described in EP1780372. Having a second diverter positioned just above the BHA 100 may be desirable for well control, pumping pills, controlling losses, or in freeing a stuck tool.

A particularly advantageous use of the exemplary wellsite system of FIG. 1 is in conjunction with controlled steering or "directional drilling." Directional drilling is the intentional deviation of the wellbore from the path it would naturally take. In other words, directional drilling is the steering of the drill string 12 so that it travels in a desired direction. Directional drilling is, for example, advantageous in offshore drilling because it enables multiple wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an exemplary embodiment that employs the wellsite system of FIG. 1 for directional drilling, a roto-steerable subsystem 150 is provided. In an exemplary RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In an exemplary "point-the-bit" rotary steerable system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. This may be achieved in a number of different ways, including a fixed bend at a point in the bottom hole assembly close to the lower stabilizer or a flexure of the drill bit drive shaft distributed between the upper and lower stabilizers. In its idealized form, the drill bit is not required to cut sideways because the bit axis is continually rotated in the direction of the curved hole. Examples of "point-the-bit" type rotary steerable systems and their operation are described in U.S. Pat. Nos. 6,394,193; 6,364,034; 6,244,361; 6,158,529; 6,092,610; and 5,113,953; and U.S. Patent Application Publication Nos. 2002/0011359 and 2001/0052428, which are expressly incorporated herein in their entireties by reference.

In an exemplary "push-the-bit" rotary steerable system, there is no specially identified mechanism that deviates the bit axis from the local bottom hole assembly axis. Instead, the requisite non-collinear condition is achieved by causing either or both of the upper or lower stabilizers to apply an eccentric force or displacement in a direction that is preferentially orientated with respect to the direction of hole propagation. This may be achieved in a number of different ways, including non-rotating (with respect to the hole) eccentric stabilizers (displacement based approaches) and eccentric actuators that apply force to the drill bit in the desired steering direction. Steering is achieved by creating non co-linearity between the drill bit and at least two other touch points. In its idealized form, the drill bit is required to cut side ways in order to generate a curved hole. Examples of "push-the-bit" type rotary steerable systems and their operation are described in U.S. Pat. Nos. 6,089,332; 5,971,085; 5,803,185; 5,778,992; 5,706,905; 5,695,015; 5,685,379; 5,673,763; 5,603,385; 5,582,259; 5,553,679; 5,553,678; 5,520,255; and 5,265,682, which are expressly incorporated herein in their entireties by reference.

Figure 2:
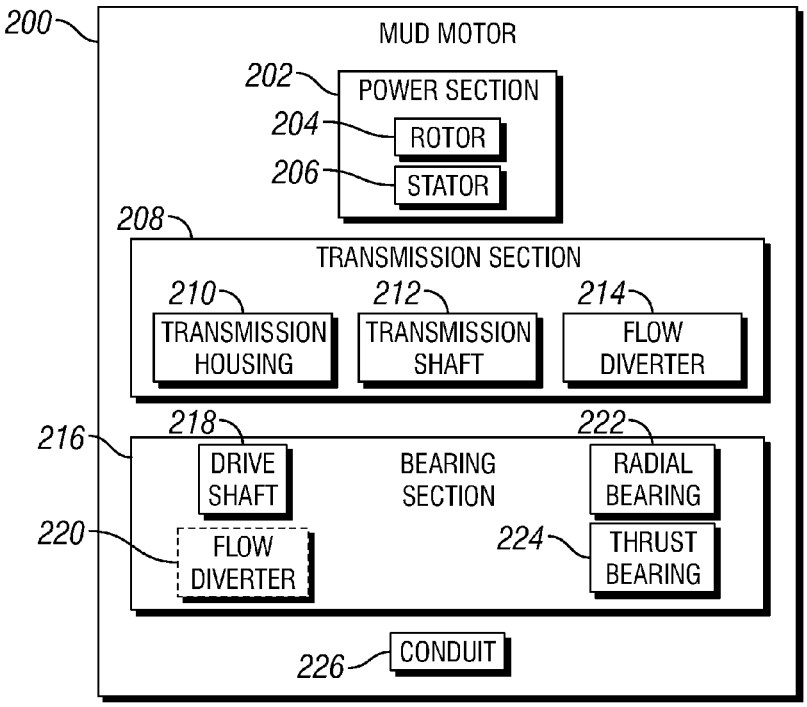
FIG. 2 is a block diagram of an exemplary downhole motor.

FIG. 2 is a block diagram of an exemplary downhole motor 200. The exemplary motor 200 includes a power section 202 that converts hydraulic energy of the drilling fluid into mechanical rotary energy, a transmission section 208 that transfers the mechanical rotary drive generated by the power section 202 to a drive shaft, and a bearing section 216 that supports axial and radial loads of the drive shaft during drilling as it transfers the mechanical rotary energy generated by the power section 202 to a downhole tool.

The power section 202 of the motor 200 includes a helical rotor 204 rotatably disposed within the longitudinal bore of a helical stator 206. The motor 200 may be fabricated in a variety of configurations. Generally, when viewed cross-sectionally, the rotor 204 has $n_r$ lobes and the stator 206 has $n_s$ lobes, wherein $n_s=n_r+1$. In operation, the helical formation on the rotor 204 seals tightly against the helical formation of the stator 206 as the rotor 204 rotates to form a set of cavities in between. The drilling fluid flows in the cavities. The hydraulic pressure of the drilling fluid causes the cavities to progress axially along the longitudinal axis of the power section, and causes a relative rotation between the rotor 204 and the stator 206 about the longitudinal axis.

The transmission section 208 of the motor 200 includes a transmission housing 210 that encloses and houses a transmission shaft 212 and a hollow central passage through which the drilling fluid may flow in a radial manner. The transmission shaft 212 is connected to the rotating rotor 204 of the power section 202 and to the drive shaft 218 of the bearing section 216. The transmission shaft 212 conveys the rotary and axial drives generated by the power section 202 to the drive shaft 218 of the bearing section 216. In an exemplary embodiment, a flow diverter 214 may be provided in the transmission section 208, e.g., disposed or formed in the transmission shaft 212, to divert the flow of the drilling fluid from an axial flow through the hollow central passage of the transmission section 208 to a radial flow through the hollow central passage of the drive shaft 218.

The bearing section 216 of the motor 200 includes a drive shaft 218 that includes a hollow central passage through which the drilling fluid may flow in a radial manner. The drive shaft 218 transfers the mechanical rotary energy transmitted by the transmission section 208 to one or more downhole tools, e.g., a drill bit. The bearing section 216 includes a set of radial bearings 222 that supports radial loads during drilling and a set of thrust bearings 224 that supports axial loads during drilling. In an exemplary embodiment, a flow diverter 220 may be provided in the bearing section 216, e.g., disposed or formed in the drive shaft 218, to divert the flow of the drilling fluid from an axial flow through the hollow central passage of the transmission section 208 to a radial flow through the hollow central passage of the drive shaft 218. The exemplary motor 200 includes one or more transmission cables 226 that run through one or more sections of the motor 200.

In conventional drilling systems, a conventional flow diverter is typically short in length and includes a single aperture for passage of the drilling fluid. The flow of the drilling fluid through the single aperture of a conventional flow diverter creates a jetting effect and impacts neighboring transmission cables at high impact velocities and substantially orthogonally to the surface of the transmission cables. This causes fast erosion of transmission cables present adjacent to a conventional flow diverter.

A number of factors affect the erosion effect of the flow of drilling fluid through a flow diverter on a transmission cable that extends adjacent to the flow diverter. An important factor affecting the rate of erosion of a transmission cable is the velocity at which the drilling fluid impinges upon or impacts the transmission cable. The rate of erosion of the transmission cable is roughly proportional to the square of the impingement or impact velocity. That is, the higher the impingement or impact velocity, the higher the rate of erosion. Exemplary embodiments provide flow diverters configured to reduce the impingement or impact velocity of the drilling fluid on a neighboring transmission cable. In an exemplary embodiment, an exemplary flow diverter is configured to be elongated along the longitudinal axis of the motor, as compared to conventional flow diverters which tend to be limited in length to 1-2 transmission shaft diameters. In an exemplary embodiment, an exemplary flow diverter may be provided with two or more apertures for the flow of drilling fluid, as opposed to conventional flow diverters that provide a single aperture for the flow of drilling fluid. In an exemplary embodiment, an exemplary flow diverter is both elongated and provided with a plurality of apertures.

Exemplary configurations of flow diverters as taught herein reduce the impingement or impact velocity of the drilling fluid on a neighboring transmission cable, i.e., the jetting effect. The exemplary configurations of flow diverters taught herein also allow the flow diverters to maintain a uniform impingement or impact velocity of the drilling fluid along the length of the flow diverters. Maintaining a uniform impingement or impact velocity prevents the formation of erosion "hot spots" where the drilling fluid impinges upon a neighboring transmission cable at a high impingement velocity, which tends to increase the erosion rate of the transmission cable in the "hot spot" regions.

Furthermore, in an exemplary embodiment, exemplary flow diverters may be used in the drill string downstream of the mud motor as a fluid filter to filter the drilling fluid being washed down from the mud motor. The drilling fluid flowing in a downward direction toward a downhole tool may contain undesirable solids that may damage the downhole tools, e.g., the fragile turbine blades of downhole drilling tools. These undesirable solids may include debris washed down from the surface and rubber chunks broken off from the power section of the mud motor. Because the drilling fluid flows through the multiple apertures of exemplary flow diverters, exemplary flow diverters may operate as a filter that allows through the fluid but filters out the undesirable solids. This dual use of exemplary flow diverters may obviate the need to employ a separate filter section operated below the mud motor. That is, exemplary flow diverters may allow exemplary mud motors to operate without a separate filter section disposed downstream of the mud motor.

FIGS. 3-7 illustrate cross-sectional views of exemplary flow diverters provided to reduce the impingement or impact velocity of the drilling fluid. The sizes of the flow diverters illustrated in FIGS. 3-7 relative to the sizes of the side walls are exaggerated for illustrative purposes.

Figure 3:
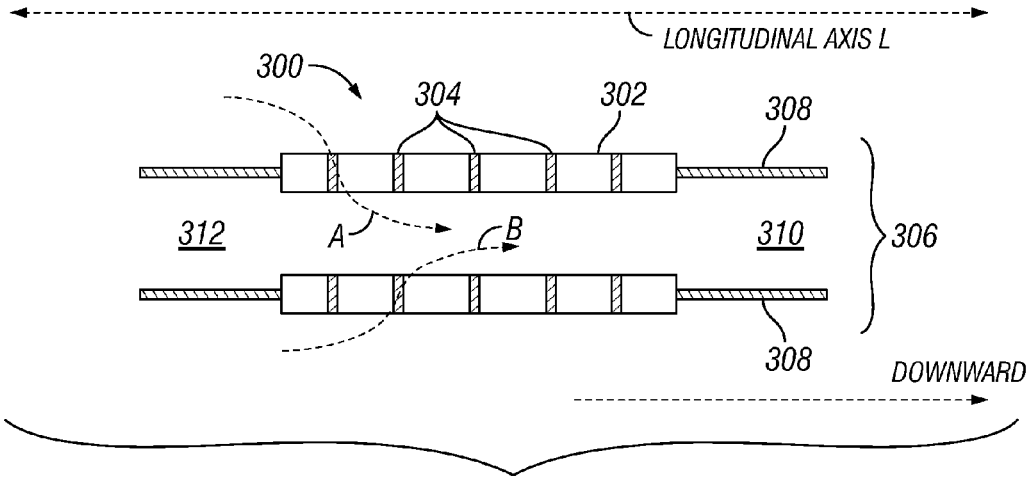
FIG. 3 is a cross-sectional view of an exemplary flow diverter.

FIG. 3 illustrates an exemplary elongated flow diverter 300 disposed or formed in a drive shaft 306. The drive shaft 306 includes a tubular wall 308 that forms and encloses a hollow central passage 310 which allows a flow of the drilling fluid. In an exemplary embodiment, an annular space or aperture is formed in the tubular wall 308 of the drive shaft 306 for accommodating the flow diverter 300. In another exemplary embodiment, the flow diverter 300 is formed integrally in the tubular wall 308 of the drive shaft 306, for example, by forming apertures of the flow diverter 300 in the tubular wall 308.

The exemplary elongated flow diverter 300 includes a body 302 that is elongated or extended along the longitudinal axis L and formed in the tubular wall 308 of the drive shaft 306. The body 302 may have any shape and size suitable for the drilling conditions, the overall drilling system and the torque requirements of the drive shaft 306.

The body 302 of the flow diverter 300 includes a plurality of apertures 304 that allow passage of the drilling fluid from an axial flow through a transmission passage 312 to a radial flow through the hollow central passage 310 of the drive shaft 306 (as illustrated by arrows A and B in FIG. 3). The apertures 304 may have any shape and size suitable for the drilling conditions and the overall drilling system, e.g., the flow rate and type of the drilling fluid, the overall power generated by the mud motor, the size of the drill string, etc. Exemplary shapes of the apertures include, but are not limited to, rectangular, circular, oval, square, irregular, etc.

In some exemplary embodiments, the apertures of a flow diverter are radially aligned along one or more radial planes. For example, a first set of apertures may be radially aligned along a first radial plane and a second set of apertures may be radially aligned along a second radial plane. In other exemplary embodiments, the apertures of a flow diverter are radially misaligned.

In some exemplary embodiments, all of the apertures of a flow diverter may have the same cross-sectional size and shape. In other exemplary embodiments, the apertures of a flow diverter may have different cross-sectional sizes and/or shapes.

Figure 4:
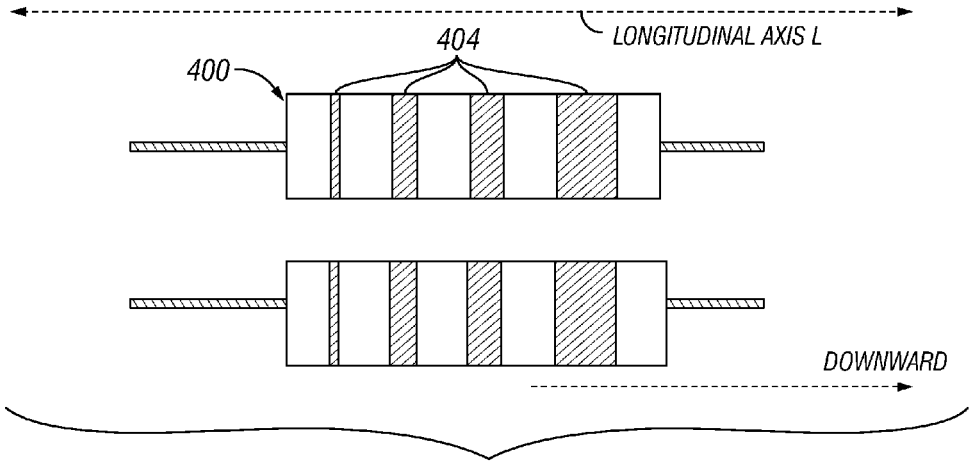
FIG. 4 is a cross-sectional view of another exemplary flow diverter.

FIG. 4 is a cross-sectional view of an exemplary flow diverter in which apertures have varying cross-sectional sizes. The apertures 404 of the elongated flow diverter 400 of FIG. 4 have increasing cross-sectional sizes along the longitudinal axis L in a downward direction toward the downhole tool or in an upward direction toward the surface. In another exemplary embodiment, the apertures may have decreasing cross-sectional sizes along the longitudinal axis L in a downward direction toward the downhole tool or in an upward direction toward the surface.

In some exemplary embodiments, e.g., as illustrated in FIGS. 3 and 4, the apertures of the flow diverters may be equally spaced from one another along the longitudinal axis L. In other exemplary embodiments, the spacing between adjacent apertures of a flow diverter may be unequal.

Figure 5:
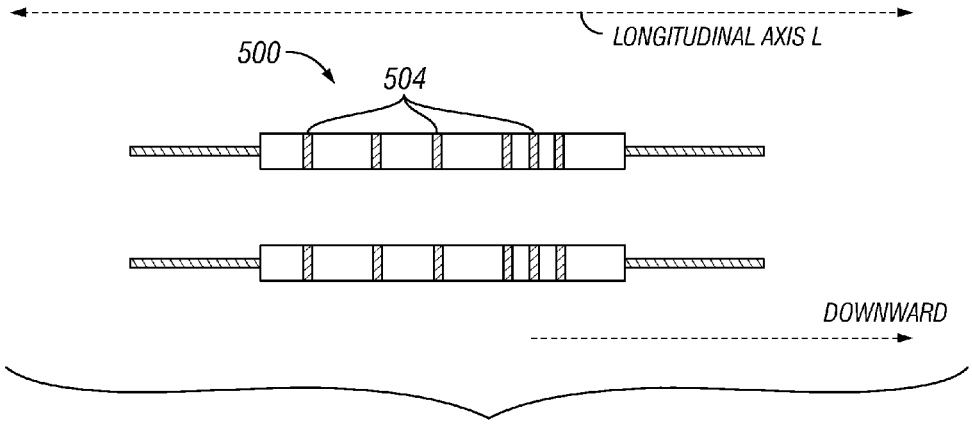
FIG. 5 is a cross-sectional view of another exemplary flow diverter.

FIG. 5 is a cross-sectional view of an exemplary flow diverter in which apertures are not equally spaced from one another. The apertures 504 of the elongated flow diverter 500 of FIG. 5 are unequally spaced out from one another along the longitudinal axis L, e.g., the spacing between adjacent apertures may become smaller along the longitudinal axis in a downward direction toward the downhole tool or in upward direction toward the surface. In another exemplary embodiment, the spacing between adjacent apertures may become larger along the longitudinal axis in a downward direction toward the downhole tool or in upward direction toward the surface.

In the exemplary embodiments illustrated in FIGS. 3 and 4, the same number of apertures may be provided in the upper and lower regions of the flow diverter. In other exemplary embodiments, e.g., as illustrated in FIG. 5, the number of apertures 504 in a region of the elongated flow diverter 500 may vary from region to region over the length of the flow diverter.

In the exemplary embodiments illustrated in FIGS. 3-5, the apertures of the flow diverters are disposed in series along the longitudinal axis of the elongated flow diverter body. In other exemplary embodiments, the apertures may be disposed in other configurations.

Figure 6A:
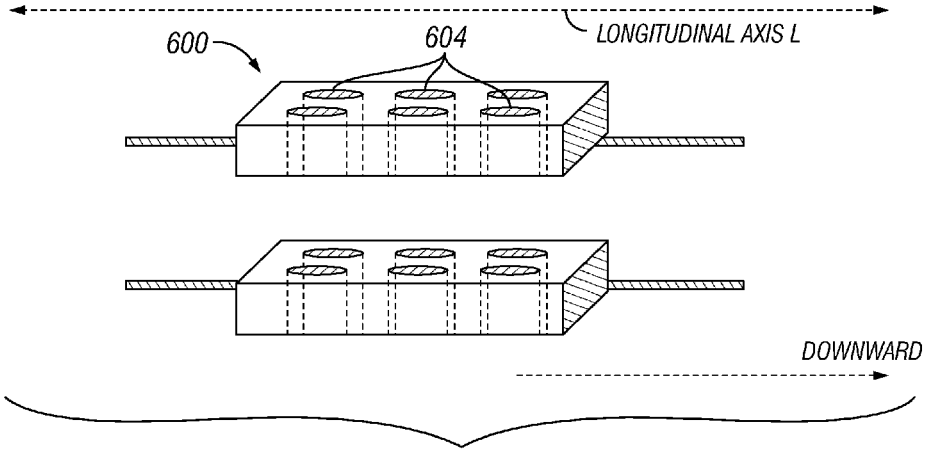
FIG. 6A is a perspective view of another exemplary flow diverter.

FIG. 6A is a perspective view of an exemplary flow diverter in which apertures are provided in multiple series, each series extending along the longitudinal axis of the flow diverter. The apertures 604 of the elongated flow diverter 600 of FIG. 6A are provided in two series that extend along the longitudinal axis L that are substantially parallel to each other.

Figure 6B:
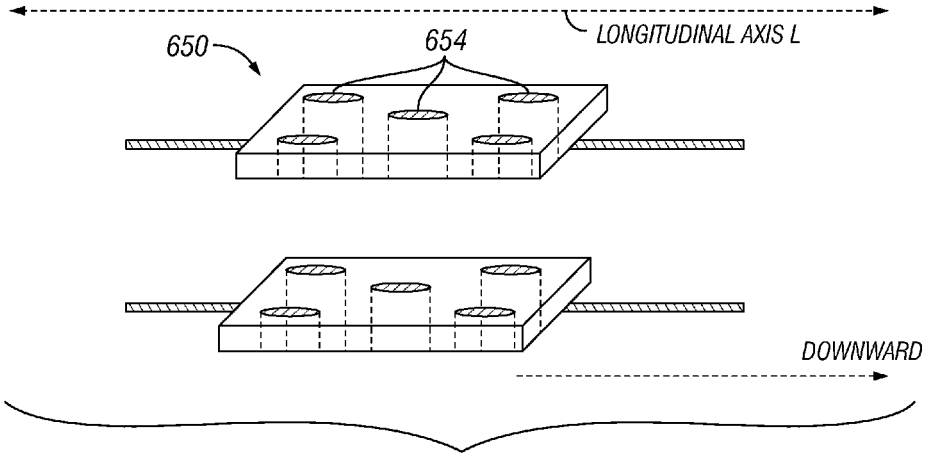
FIG. 6B is a perspective view of another exemplary flow diverter.

FIG. 6B is a perspective view of another exemplary flow diverter in which apertures are provided in multiple series, each series extending radially about the diverter 650 in separate racial planes. Each of the radial planes is spaced apart and extends in a direction along the longitudinal axis of the flow diverter. The apertures 654 of the elongated flow diverter 650 of FIG. 6B are provided in three radial series that extend along the longitudinal axis L that are substantially parallel to each other. The apertures 654 are placed in alternate rows in the three series. In some embodiments, the radial planes of the apertures may overlap so that the apertures are longitudinally staggered along the longitudinal axis of the diverter.

Figure 7:
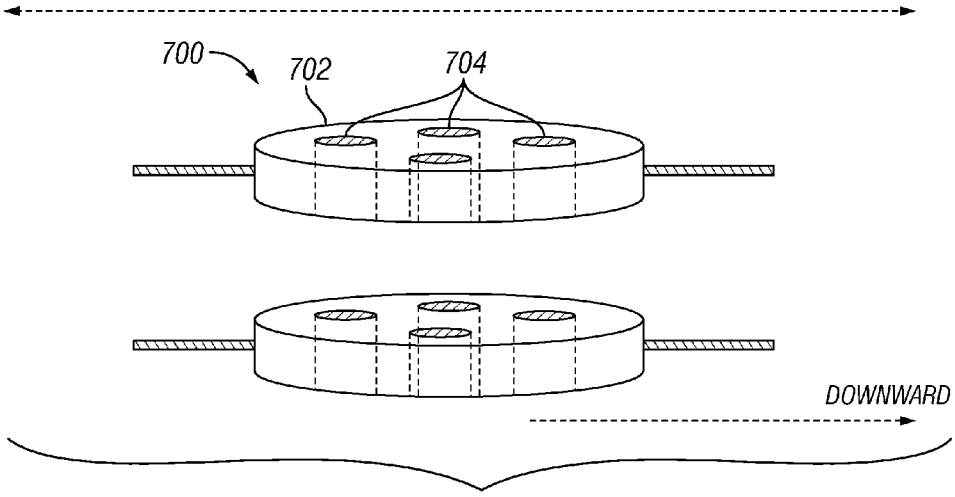
FIG. 7 is a perspective view of another exemplary flow diverter.

FIG. 7 is a perspective view of an exemplary flow diverter in which apertures are provided in a substantially oval arrangement. The apertures 704 of the elongated flow diverter 700 of FIG. 7 are provided in a substantially oval arrangement in a substantially oval flow diverter body 702.

The configuration of exemplary flow diverters may depend on drilling conditions. Exemplary flow diverters are not limited to the exemplary embodiments illustrated in FIGS. 3-7. One of ordinary skill in the art will recognize that many alterations and modifications may be made to the illustrated flow diverters.

Another important factor affecting the rate of erosion of a transmission cable is the angle at which the drilling fluid impinges upon or impacts the transmission cable. The rate of erosion of the transmission cable is highest when the impingement or impact angle is 90 degrees relative to the longitudinal axis of the transmission cable, and tends to decrease at shallower angles deviating from 90 degrees. That is, the shallower the impingement or impact angle, the lower the rate of erosion. Exemplary embodiments provide flow diverters configured to make the impingement or impact angle shallower than 90 degrees, such that the drilling fluid does not impinge upon the transmission cable orthogonally but at shallower angles. In an exemplary embodiment, an exemplary flow diverter is provided with apertures that are formed at an angle, by way of non-limiting example only, any suitable angle between about 30 degrees and about 60 degrees. That is, for an exemplary flow diverter that extends along the longitudinal axis of a drill string, the apertures are provided at an angle that deviates from the transverse axis perpendicular to the longitudinal axis.

Figure 8:
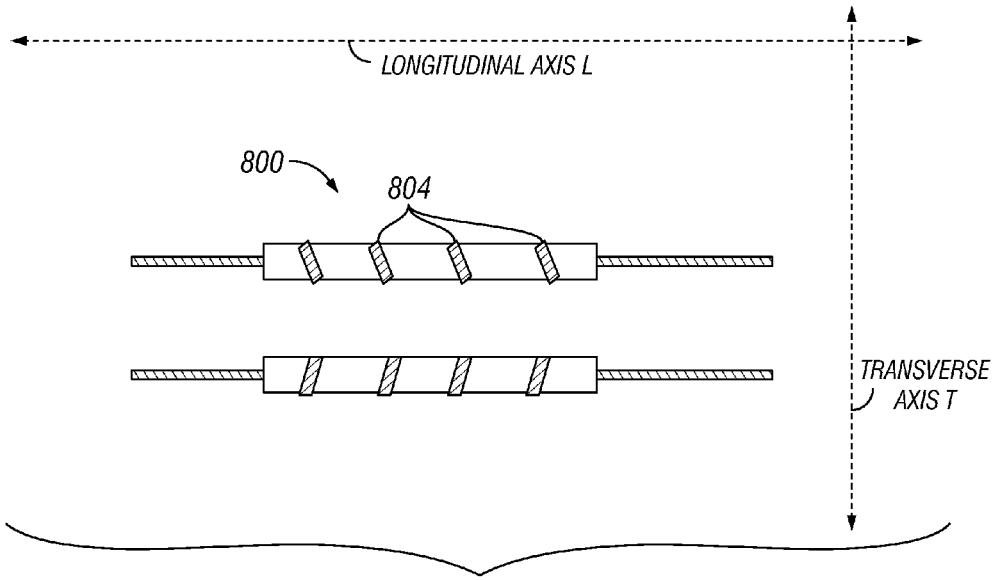
FIG. 8 is a cross-sectional view taken along a longitudinal axis of an exemplary flow diverter.

FIG. 8 illustrates a sectional view taken through the longitudinal axis L of an exemplary flow diverter 800 in which the apertures 804 are provided at an angle that deviates or that is offset from the transverse axis T of the drive shaft. A transmission cable (not shown) may extend substantially along the longitudinal axis L in the interior region of the drive shaft. Drilling fluid flowing through the flow diverter 800 at an angle to the transverse axis T is prevented from impinging upon or impacting the longitudinally-extending transmission cable substantially orthogonally to the surface of the transmission cable. This modification of the impingement or impact angle of the drilling fluid by exemplary flow diverter 800 reduces the rate of erosion of the transmission cable.

Another factor affecting the rate of erosion of a transmission cable is the material that is being eroded, i.e., the properties of the material such as hardness, material type, thickness, etc. Exemplary drilling fluids may include mud and slurry that can contain hard particles. These hard particles may cause fast erosion of a transmission cable present near a flow diverter.

In an exemplary embodiment, in order to minimize erosion of a transmission cable due to hard particles present in the drilling fluid, an exemplary transmission cable is provided with a protective sleeve. Exemplary embodiments allow selective configuration of the protective sleeve, e.g., hardness, thickness, material type, etc., to provide improved protection of the encased transmission cable from erosion. In an exemplary embodiment, the material forming the protective sleeve has a hardness that exceeds the hardness of the particles being washed down in the drilling fluid, e.g., tungsten carbide ("WC") materials, diamond or diamond compounds, ceramics, etc. In another exemplary embodiment, the material forming the protective sleeve is rubbery.

Figure 9A:
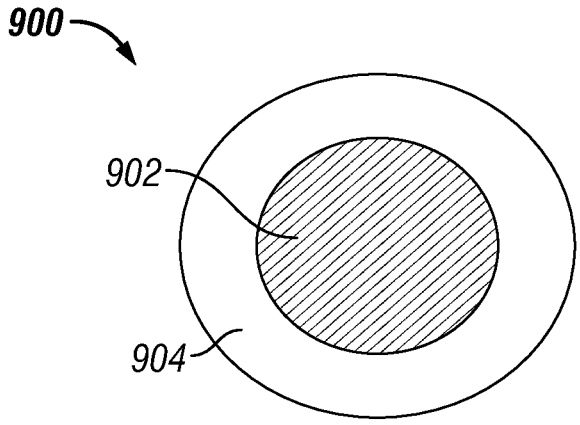
FIG. 9A illustrates a transverse section taken through a transmission cable that is not provided with a protective sleeve.

FIG. 9A illustrates a transverse section taken through a transmission cable 900 that is not provided with a protective sleeve. The transmission cable 900 includes a conductor 902 forming a conductive core that extends along the longitudinal axis through the center of the transmission cable 900. The conductive core is able to conduct electric power, and data and instructions encoded as electrical signals, optical signals and/or power. In some exemplary embodiments, a single conductor forms the conductive core and, in other exemplary embodiments, multiple combined conductors form the core. The transmission cable 900 includes an outer jacket 904 that surrounds and protects the conductor 902.

Figure 9B:
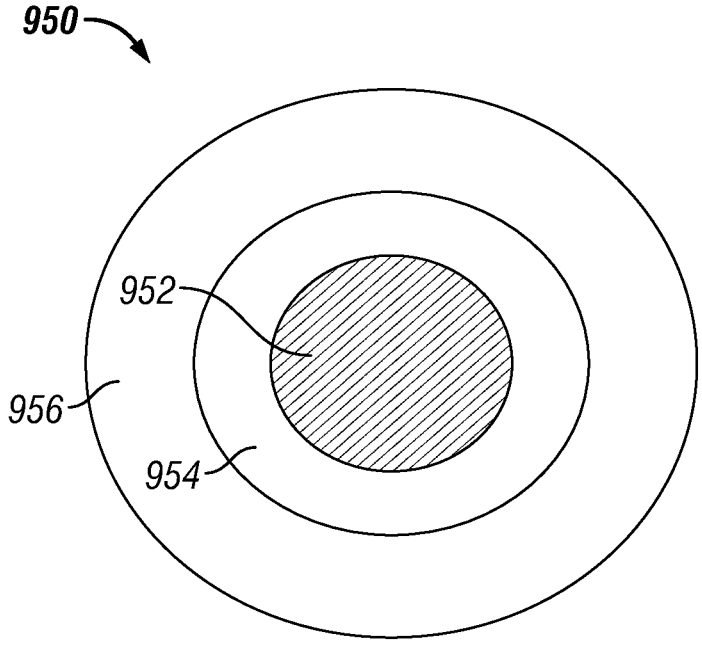
FIG. 9B illustrates a transverse section taken through a transmission cable that is provided with a protective sleeve.

FIG. 9B illustrates a transverse section taken through a transmission cable 950 that is provided with a protective sleeve. The transmission cable 950 includes a conductor 952 forming a conductive core that extends along the longitudinal axis through the center of the transmission cable 950. The transmission cable 950 includes an outer jacket 954 that surrounds and protects the conductor 952. The transmission cable 950 is surrounded and protected by a protective sleeve 956 formed of a hard material. The protective sleeve 956 protects the transmission cable 950 from the jetting effect created by the flow of the drilling fluid through a flow diverter that is disposed adjacent to the transmission cable 950.

In an exemplary embodiment, the protective sleeve 956 may extend over portions of the transmission cable 950 that are adjacent to the region of a flow diverter. In another exemplary embodiment, the protective sleeve 956 may extend over the entire length of the transmission cable 950.

In an exemplary embodiment, the protective sleeve 956 may be disposed uniformly, i.e., having a uniform thickness, along a selected length of the transmission cable 950 adjacent to the flow diverter. In another exemplary embodiment, the protective sleeve 956 may be disposed non-uniformly, i.e., having varying thicknesses, along a selected length of the transmission cable 950 adjacent to the flow diverter. For example, the protective sleeve 956 may have a decreasing thickness in a downward direction toward the downhool tool, e.g., drill bit.

Figure 10:
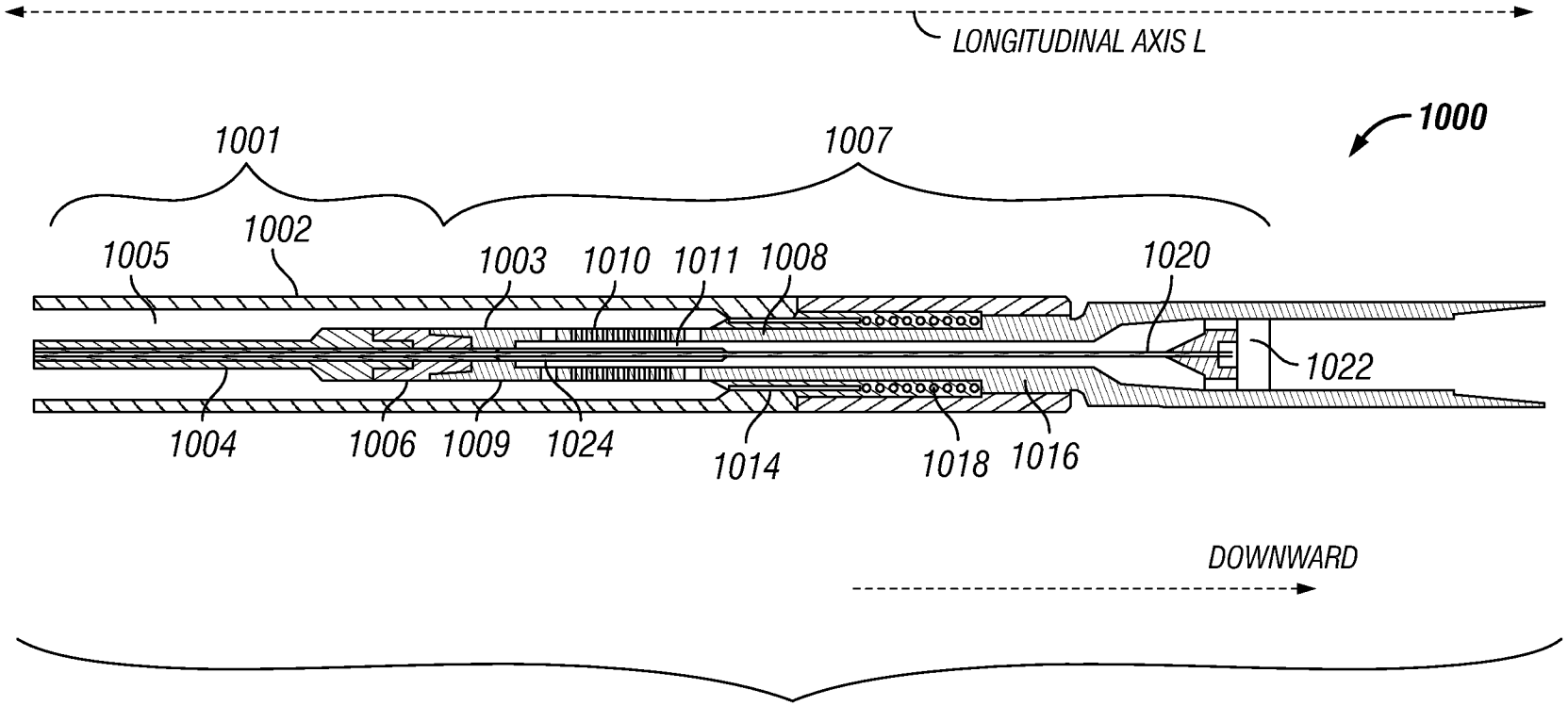
FIG. 10 illustrates a cross-sectional view taken along a longitudinal axis extending through portions of a transmission section and a bearing section of an exemplary motor, in which the flow diverter is elongated and provided with a plurality of apertures and in which the drive shaft is a one-piece drive shaft.

FIG. 10 illustrates a sectional view taken along the longitudinal axis L of portions of a transmission section 1001 and a bearing section 1007 of an exemplary motor 1000, in which the flow diverter is elongated and includes a plurality of apertures and in which the drive shaft is a one-piece drive shaft.

The transmission section includes a tubular transmission housing 1002 having a hollow central passage 1005. The tubular transmission housing 1002 encloses a transmission shaft 1004 in the hollow central passage 1005 through which the drilling fluid may flow in an axial manner. One end (not shown) of the transmission shaft 1004 is connected to the power section of the motor 1000, and another end of the transmission shaft 1004 is connected to a drive shaft 1008 of the bearing section. In an exemplary embodiment, one or more coupling or fitting mechanisms 1006 may be provided at the connection between the transmission shaft 1004 and the drive shaft 1008 for providing a reliable coupling between the two shafts.

Figure 11:
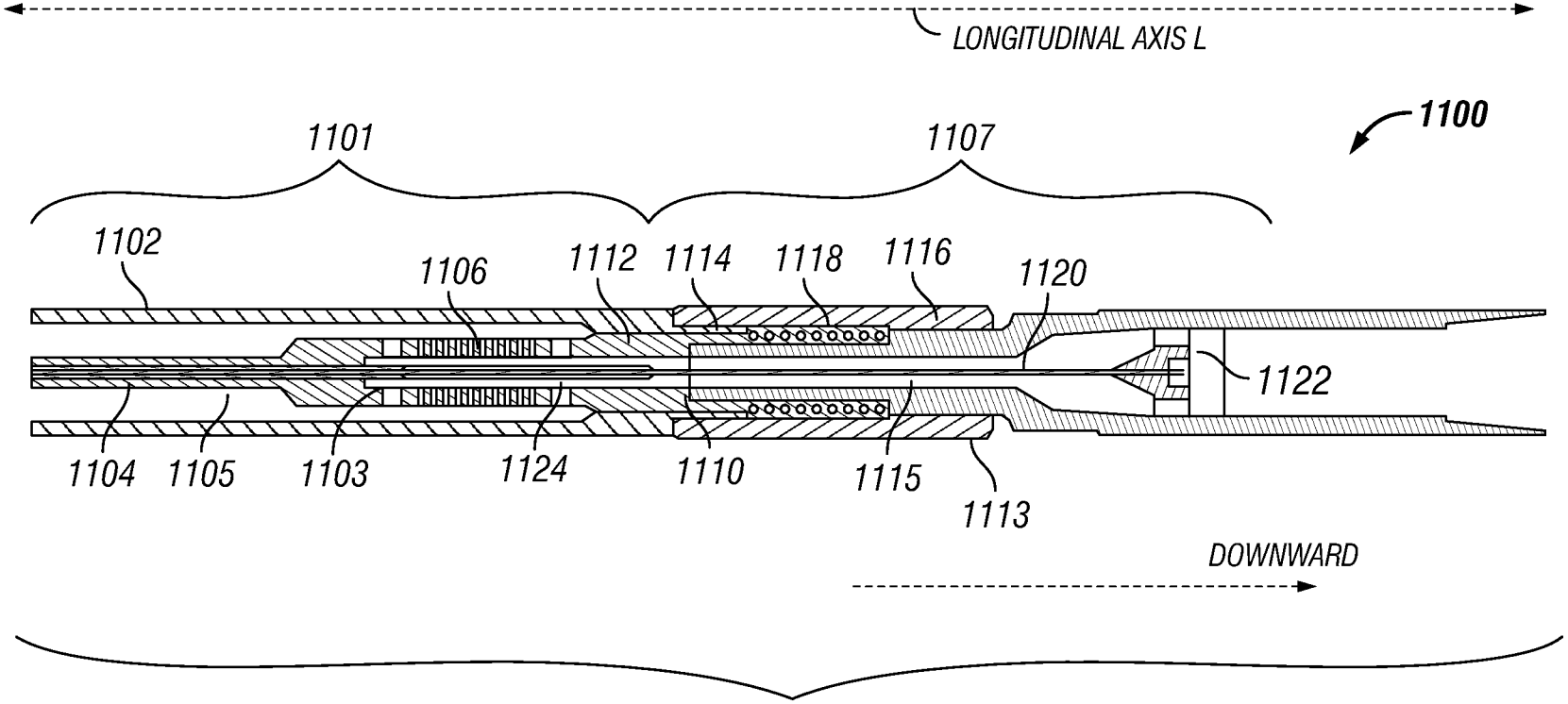
FIG. 11 illustrates a cross-sectional view taken along a longitudinal axis extending through portions of a transmission section and a bearing section of an exemplary motor, in which the flow diverter is elongated and provided with a plurality of apertures and in which the drive shaft is a two-piece drive shaft.
Figure 13:
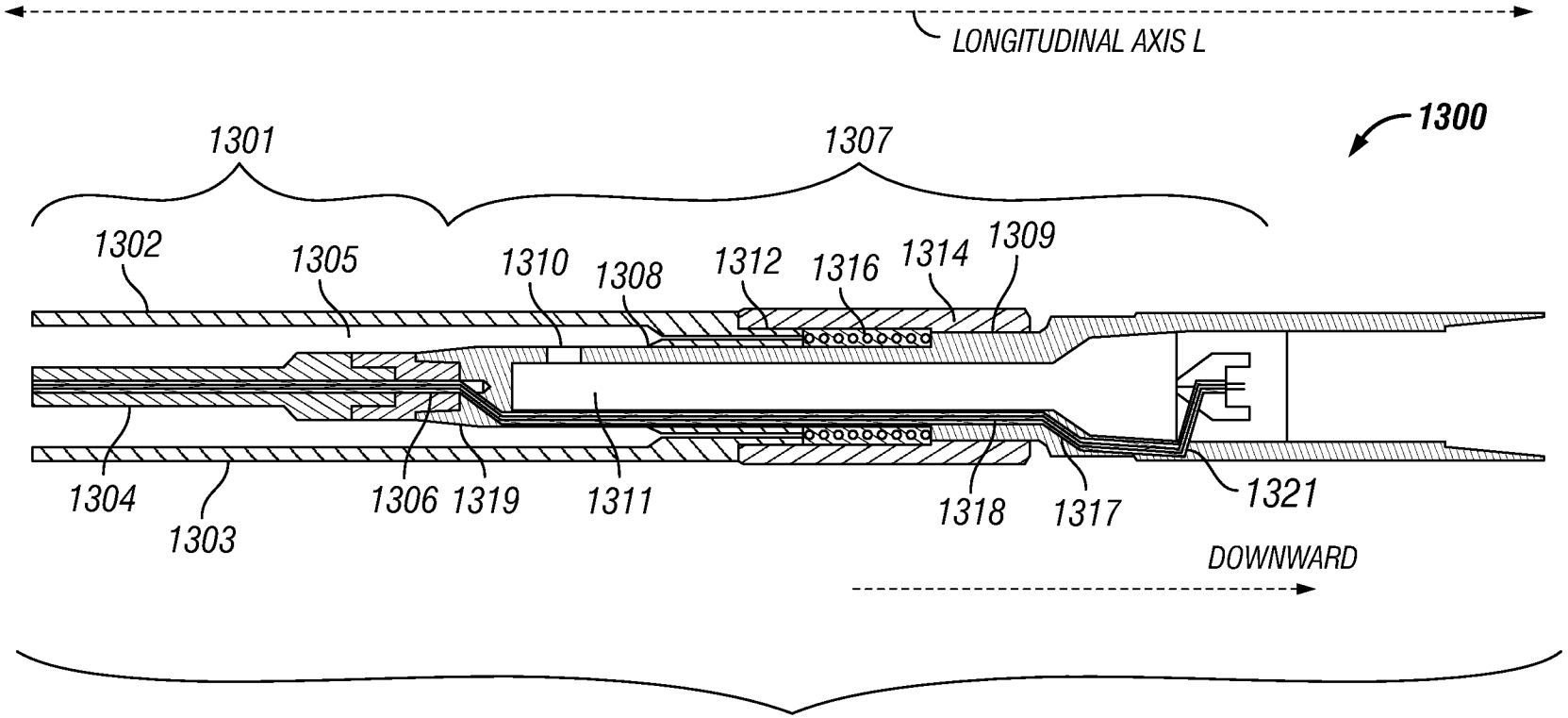
FIG. 13 illustrates a cross-sectional view taken along a longitudinal axis extending through portions of a transmission section and a bearing section of an exemplary motor, in which a transmission cable is provided in a bore extending through a radial wall of the drive shaft along the longitudinal axis.

The bearing section includes a one-piece drive shaft 1008 having a tubular wall 1009 that encloses a hollow central passage 1011 through which the drilling fluid may flow in a radial manner. An exemplary flow diverter 1010 is disposed or formed in the tubular wall 1009 of the drive shaft 1008 for diverting the flow of the drilling fluid from the axial flow through the hollow central passage 1005 of the transmission section to a radial flow through the hollow central passage 1011 of the drive shaft 1008. The flow diverter 1010 is elongated and includes a plurality of apertures configured to reduce the jetting effect created by the drilling fluid flowing through the flow diverter 1010. The drive shaft 1008 may be a one-piece drive (as illustrated in FIGS. 10 and 13) or a two-piece drive shaft (as illustrated in FIG. 11). The bearing section also includes a set of upper radial bearings 1014 and a set of lower radial bearings 1016 that support radial loads during drilling, and a set of thrust bearings 1018 that supports axial loads during drilling.

One or more transmission cables extend along the longitudinal axis L in the hollow central passage 1011 of the bearing section to connect to one or more connectors 1022. A terminal end of the drive shaft 1008 includes a borehole 1003 extending longitudinally through which the transmission cable extends longitudinally.

Exemplary embodiments may also minimize erosion effects on the transmission cable 1020 by providing a protective sleeve 1024 around the transmission cable 1020 to protect the transmission cable 1020 from erosion caused by the flow of the drilling fluid through the flow diverter 1010. In an exemplary embodiment, the protective sleeve 1024 may extend over portions of the transmission cable 1020 that are adjacent to the region of the flow diverter 1010. In another exemplary embodiment, the protective sleeve 1024 may extend over the entire outer surface of the transmission cable 1020.

In an exemplary embodiment, the protective sleeve 1024 may be disposed uniformly, i.e., having a uniform thickness or diameter, along the entire length of the transmission cable 1020. In another exemplary embodiment, the protective sleeve 1024 may be disposed non-uniformly, i.e., having varying thicknesses or diameters, along the length of the transmission cable 1020. For example, the protective sleeve 1024 may have a decreasing thickness or diameter along the length of the transmission cable 1020 in a downward direction toward the downhool tool, e.g., drill bit.

FIG. 11 illustrates a cross-sectional view taken along the longitudinal axis L of portions of a transmission section 1101 and a bearing section 1107 of an exemplary motor 1100, in which the flow diverter is elongated and provided with a plurality of apertures and in which the drive shaft is a two-piece drive shaft.

The transmission section includes a transmission housing 1102 having a tubular wall 1103 and a hollow central passage 1105. A transmission shaft 1104 is longitudinally disposed in the hollow central passage 1105 through which the drilling fluid may flow in an axial manner. One end (not shown) of the transmission shaft 1104 is connected to the power section of the motor 1100, and another end of the transmission shaft 1104 is connected to the drive shaft 1112 that longitudinally extends through the bearing section 1107. In an exemplary embodiment, one or more coupling or fitting mechanisms 1110 may be provided at the connection between the transmission shaft 1104 and the drive shaft 1112 for providing a reliable coupling between the two shafts.

The drive shaft 1112 is a two-piece drive shaft having at least one tubular wall 1113 that encloses a hollow central passage 1115 through which the drilling fluid may flow in a radial manner. The bearing section also includes a set of upper radial bearings 1114 and a set of lower radial bearings 1116 that support radial loads during drilling, and a set of thrust bearings 1118 that supports axial loads during drilling.

An exemplary flow diverter 1106 is disposed or formed in the tubular wall 1103 of the transmission shaft 1104 for diverting the flow of the drilling fluid from an axial flow through the hollow central passage 1005 of the transmission section to a radial flow through the hollow central passage 1115 of the drive shaft 1112. The flow diverter 1106 is elongated and includes a plurality of apertures configured to reduce the jetting effect created by the drilling fluid flowing through the flow diverter 1106.

One or more transmission cables extend along the longitudinal axis L in the hollow central passages 1105 and 1115 of the transmission and bearing sections, respectively, to connect to one or more connectors 1122.

Exemplary embodiments may also minimize erosion effects on the transmission cable 1120 by providing a protective sleeve 1124 around the transmission cable 1120 to protect the transmission cable 1120 from erosion caused by the flow of the drilling fluid through the flow diverter 1106. In an exemplary embodiment, the protective sleeve 1124 may extend over portions of the transmission cable 1120 that are adjacent to the region of the flow diverter 1106. In another exemplary embodiment, the protective sleeve 1124 may extend over the entire outer surface of the transmission cable 1120.

In an exemplary embodiment, the protective sleeve 1124 may be disposed uniformly, i.e., having a uniform thickness or diameter, along the entire length of the transmission cable 1120. In another exemplary embodiment, the protective sleeve 1124 may be disposed non-uniformly, i.e., having varying thicknesses or diameters, along the length of the transmission cable 1120. For example, the protective sleeve 1124 may have a decreasing thickness or diameter along the length of the transmission cable 1120 in a downward direction toward the downhool tool, e.g., drill bit, or a decreasing thickness or diameter in an upward direction toward the surface or an uphole tool. In another example, the protective sleeve 1124 may have its greatest thickness or diameter at an erosion "hot spot," i.e., where erosion is locally more severe. An exemplary erosion "hot spot" is the region near the apertures of a flow diverter. The thickness or diameter of the protective sleeve 1124 may vary smoothly or gradually over the length of the transmission cable 1120 or may vary in steps. For example, a first portion of the cable may have a first larger thickness or diameter, and a second portion of the cable may have a second smaller thickness or diameter.

Figure 12:
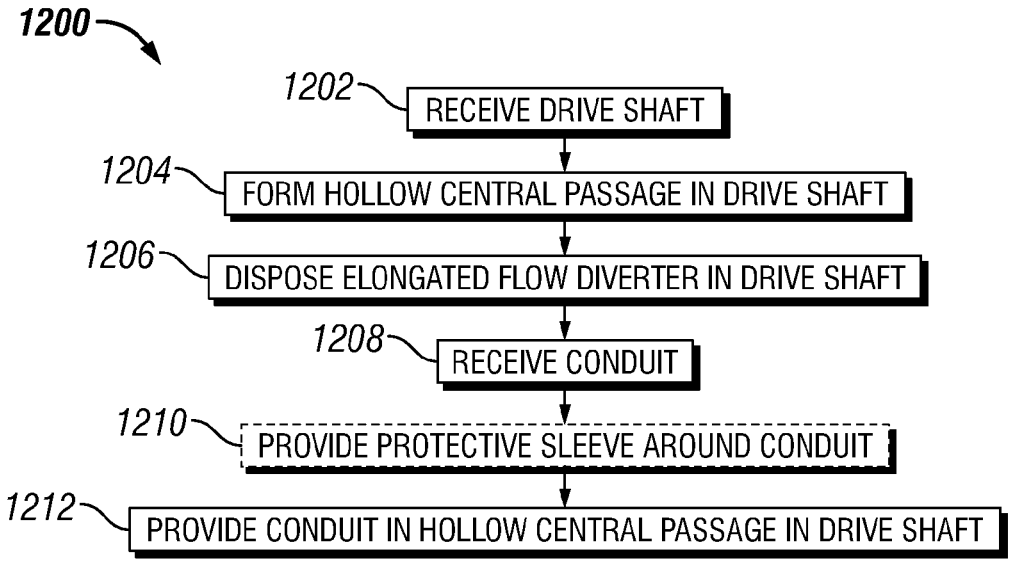
FIG. 12 is a flow chart illustrating an exemplary method for manufacturing the exemplary drilling systems of FIGS. 10 and 11.

FIG. 12 is a flow chart illustrating an exemplary method 1200 for manufacturing the exemplary drilling systems of FIGS. 10 and 11. In step 1202, a drive shaft is received. The drive shaft longitudinally extends through a bearing section of a motor for transmitting torque generated by the motor to a downhole tool, e.g., a drill bit. In step 1204, a hollow central passage extending along the longitudinal axis is formed in and enclosed by a tubular wall of the drive shaft. The hollow central passage allows the flow of a drilling fluid through the bearing section. In step 1206, an exemplary flow diverter is disposed or formed in the tubular wall of the drive shaft. The exemplary flow diverter is elongated and includes a plurality of apertures for diverting the flow of the drilling fluid from an axial flow through the hollow central passage of the transmission shaft to a radial flow through the hollow central passage of the drive shaft. The elongated configuration of the exemplary flow diverter with the plurality of apertures minimizes the jetting effect created by the flow of the drilling fluid through the flow diverter and, thereby, minimizes erosion of a transmission cable provided in the hollow central passage caused by such a jetting effect.

In step 1208, one or more transmission cables are received. In step 1210, the transmission cables may be surrounded with a protective sleeve to protect the transmission cables from erosion. In an exemplary embodiment, the protective sleeve may extend over portions of the transmission cable that are adjacent to the region of the flow diverter. In another exemplary embodiment, the protective sleeve may extend over the entire outer surface of the transmission cable.

In an exemplary embodiment, the protective sleeve may be disposed uniformly, i.e., having a uniform thickness or diameter, along the entire length of the transmission cable. In another exemplary embodiment, the protective sleeve may be disposed non-uniformly, i.e., having varying thicknesses, along the length of the transmission cable. For example, the protective sleeve may have a decreasing thickness along the length of the transmission cable in a downward direction toward the downhool tool, e.g., drill bit.

In step 1212, the transmission cables are made to extend longitudinally in the hollow central passage of the drive shaft. Exemplary embodiments may minimize erosion effects on a transmission cable by disposing the transmission cable within a bore extending through the tubular wall of the drive shaft and/or the transmission shaft. The passage may be gun-drilled longitudinally through a portion of the radial wall. In this exemplary embodiment, the transmission cable is not in direct contact with the flow of the drilling fluid and is therefore not eroded by the flow of the drilling fluid through a flow diverter. The transmission cable may be provided in a bore longitudinally extending through a radial wall of a one-piece drive shaft or a two-piece drive shaft.

FIG. 13 illustrates a cross-sectional view taken along the longitudinal axis L of portions of a transmission section 1301 and a bearing section 1307 of an exemplary motor 1300 in which a transmission cable is provided in a bore longitudinally extending through a tubular wall of the drive shaft.

The transmission section 1301 includes a tubular transmission housing 1302 having hollow central passage 1305. The tubular transmission housing 1302 encloses a transmission shaft 1304 in the hollow central passage 1305 through which the drilling fluid may flow in an axial manner. One end (not shown) of the transmission shaft 1304 is connected to the power section of the motor 1300, and another end of the transmission shaft 1304 is connected to a drive shaft 1308 of the bearing section 1307. In an exemplary embodiment, one or more coupling or fitting mechanisms 1306 may be provided at the connection between the transmission shaft 1304 and the drive shaft 1308 to provide a reliable coupling between the two shafts.

The bearing section 1307 includes a one-piece drive shaft 1308 having a tubular wall 1309 that encloses a hollow central passage 1311 through which the drilling fluid may flow in a radial manner. A conventional flow diverter 1310 is disposed or formed in the tubular wall 1309 of the drive shaft 1308 to divert the flow of the drilling fluid from an axial flow through the hollow central passage 1305 of the transmission section to a radial flow through the bearing section. The conventional flow diverter 1310 is not elongated along the longitudinal axis L and includes a single aperture. In other exemplary embodiments, an exemplary flow diverter may be used which is elongated and includes a plurality of apertures configured to reduce the jetting effect created by the drilling fluid flowing through the flow diverter 1310. The drive shaft 1308 may be a one-piece drive (as illustrated in FIG. 13) or a two-piece drive shaft (not shown). The bearing section also includes a set of upper radial bearings 1312 and a set of lower radial bearings 1314 that support radial loads during drilling, and a set of thrust bearings 1316 that supports axial loads during drilling.

The tubular wall 1309 of the drive shaft 1308 includes a bore 1317 running from a first end 1319 to a second end 1321 longitudinally therein. In an exemplary embodiment, the bore 1317 may be gun-drilled. One or more transmission cables extend along the longitudinal axis L in the bore 1317 through the tubular wall 1309 of the drive shaft 1308 to connect to one or more connectors 1320. Because the transmission cable 1318 is disposed in the bore 1317 extending through the tubular wall 1309 of the drive shaft 1308, as opposed to in the hollow central passage 1311 enclosed by the tubular wall 1309, the transmission cable 1318 is not in direct contact with the flow of the drilling fluid and is therefore not eroded by the flow of the drilling fluid through the flow diverter 1310. The transmission cable may be provided in a bore extending through the radial wall of a one-piece drive shaft (as illustrated in FIG. 13) or a two-piece drive shaft (not shown).

Figure 14:
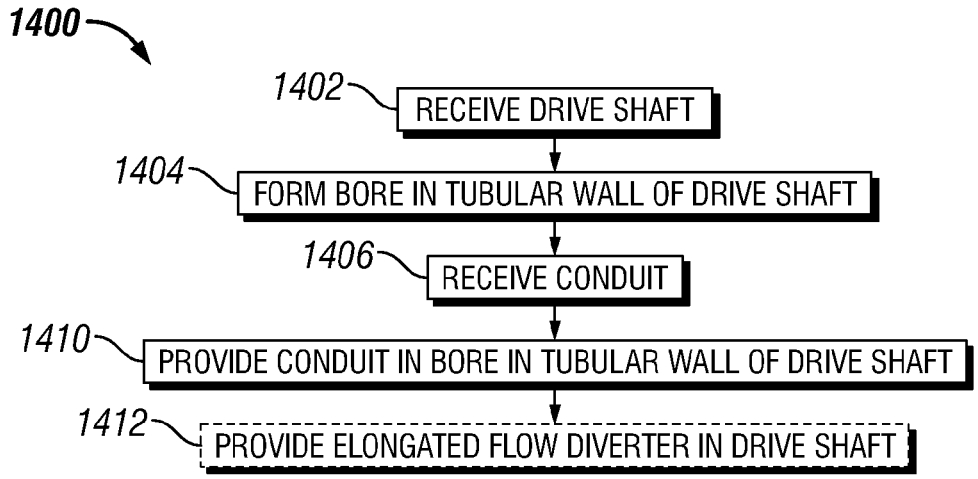
FIG. 14 is a flow chart illustrating an exemplary method for manufacturing the exemplary drilling system of FIG. 13.

FIG. 14 is a flow chart illustrating an exemplary method 1400 for manufacturing the exemplary drilling system of FIG. 13. In step 1402, a drive shaft is received. The drive shaft forms part of the bearing section of a motor for transmitting torque generated by the motor to a downhole tool, e.g., a drill bit. In step 1404, a bore extending from a first end to a second end along the longitudinal axis L is formed in a tubular wall of the drive shaft. The bore may be gun-drilled in the tubular wall in an exemplary embodiment.

In step 1406, one or more transmission cables are received. In step 1410, the transmission cables are pushed through the bore formed in the tubular wall of the drive shaft. The tubular wall of the drive shaft protects the transmission cables from erosion caused by a flow of a drilling fluid through a hollow central passage formed by and enclosed within the tubular wall of the drive shaft.

In step 1412, an exemplary flow diverter may be disposed or formed in the tubular wall of the drive shaft. In an exemplary embodiment, the exemplary flow diverter is elongated and includes a plurality of apertures for diverting the flow of the drilling fluid from an axial flow through a hollow central passage of a transmission shaft to a radial flow through a hollow central passage of a drive shaft. The elongated configuration of the exemplary flow diverter with the multiple apertures minimizes the jetting effect created by the flow of the drilling fluid through the flow diverter and, thereby, minimizes erosion of a transmission cable provided adjacent to the flow diverter caused by such a jetting effect.

One of ordinary skill in the art will appreciate that the present invention is not limited to the specific exemplary embodiments described herein. Many alterations and modifications may be made by those having ordinary skill in the art without departing from the spirit and scope of the invention. One of ordinary skill in the art will recognize, or be able to ascertain using no more than routine experimentation, many equivalents of the specific embodiments of the invention described herein. Such equivalents are intended to be encompassed by the following claims. Therefore, it must be expressly understood that the illustrated embodiments have been shown only for the purposes of example and should not be taken as limiting the invention, which is defined by the following claims. These claims are to be read as including what they set forth literally and also those equivalent elements which are insubstantially different, even though not identical in other respects to what is shown and described in the above illustrations.

INCORPORATION BY REFERENCE

All patents, published patent applications and other references disclosed herein are hereby expressly incorporated herein in their entireties by reference.

What is claimed is:

1. A system for drilling, comprising:

a drive shaft for transmitting a torque to a downhole tool, the drive shaft having a hollow central passage formed by a tubular wall extending along a longitudinal axis L thereof, the hollow central passage allowing a flow of a drilling fluid through a bearing section of the system; and an elongated flow diverter disposed in the tubular wall of the drive shaft, the elongated flow diverter having a body comprising a plurality of axially-spaced apertures distributed along the longitudinal axis L of the drive shaft and the hollow central passage, the distribution of the plurality of apertures along the longitudinal axis L reducing the impingement of the drilling fluid while diverting the flow of the drilling fluid from an upstream annulus section of the system to the hollow central passage.

2. The system of claim 1, further comprising:

a transmission cable extending through the hollow central passage of the drive shaft.

3. The system of claim 2, wherein the plurality of apertures are configured to protect the transmission cable from erosion from the flow of the drilling fluid.

4. The system of claim 2, wherein the transmission cable is an electrical cable for supplying electrical power to the downhole tool.

5. The system of claim 2, wherein the transmission cable carries any of data, instructions or data and instructions between the downhole tool and an uphole tool.

6. The system of claim 2, further comprising:

a protective sleeve surrounding the transmission cable for protecting the transmission cable from erosion from the flow of the drilling fluid.

7. The system of claim 6, wherein the protective sleeve has a decreasing thickness in a downward direction toward the downhole tool.

8. The system of claim 6, wherein the protective sleeve has a uniform thickness along the entire length thereof.

9. The system of claim 6, wherein the protective sleeve has a greater thickness at a region of the transmission cable where erosion is locally severe.

10. The system of claim 9, wherein the region of the transmission cable is adjacent to the plurality of apertures of the elongated flow diverter.

11. The system of claim 1, wherein the drive shaft is a one-piece drive shaft.

12. The system of claim 1, wherein the drive shaft is a two-piece drive shaft.

13. The system of claim 1, wherein the plurality of apertures in the elongated flow diverter are equally spaced from one another.

14. The system of claim 1, wherein the plurality of apertures in the elongated flow diverter are provided in series along the longitudinal axis of the drive shaft.

15. The system of claim 1, wherein each of the plurality of apertures in the elongated flow diverter has the same size.

16. The system of claim 1, wherein the plurality of apertures in the elongated flow diverter have decreasing sizes extending downstream along the longitudinal axis of the drive shaft toward the downhole tool.

17. The system of claim 1, wherein the plurality of apertures in the elongated flow diverter have increasing sizes extending downstream along the longitudinal axis of the drive shaft toward the downhole tool.

18. The system of claim 1, wherein the elongated flow diverter diverts an axial flow of the drilling fluid to a radial flow.

19. The system of claim 1, wherein two of the plurality of apertures are axially spaced apart along the longitudinal axis L by a distance that is greater than 200% of a diameter of the drive shaft.

20. A system for drilling, comprising:

a drive shaft for transmitting a torque to a downhole tool, the drive shaft having a tubular wall around a hollow central passage for carrying a flow of drilling fluid, the tubular wall having a bore extending from a first end to a second end through the tubular wall along a longitudinal axis thereof and external to the hollow central passage;

a flow diverter having a body disposed in the tubular wall of the drive shaft between the first end and the second end, the flow diverter including a plurality of axially-spaced apertures distributed along the longitudinal axis of the drive shaft and the hollow central passage, wherein the apertures are configured to divert drilling fluid flow from an upstream annulus section of the system to the hollow central passage; and an electrical cable extending through the bore in the tubular wall of the drive shaft for supplying electrical power to the downhole tool.

21. The system of claim 20, wherein the bore is a gun-drilled bore.

22. The system of claim 20, wherein the tubular wall of the drive shaft protects the electrical cable from erosion from a flow of a drilling fluid in a bearing section of the system.

23. The system of claim 20, wherein the apertures in the body are configured to protect the electrical cable from erosion from the flow of the drilling fluid through the flow diverter.

24. The system of claim 20, wherein the flow diverter is an elongated flow diverter.

* * * * *